United States Patent [19]

Holliday

[11] Patent Number: 5,029,505

[45] Date of Patent: Jul. 9, 1991

[54] STEEL RULE DIE HOLDER

[75] Inventor: Ken Holliday, Decature, Ga.

[73] Assignee: Southeastern Die Company, Inc., Decatur, Ga.

[21] Appl. No.: 476,305

[22] Filed: Feb. 7, 1990

[51] Int. Cl.[5] ..... B26D 7/26; B26F 1/46

[52] U.S. Cl. ..... 83/652; 83/698; 76/107.8

[58] Field of Search ..... 83/698, 531, 532, 652, 83/654, 655, 657, 669, 684, 651, 55, 686, 673; 76/107.4, 107.8

[56] References Cited

U.S. PATENT DOCUMENTS

| | | | |
|---|---|---|---|
| 2,821,871 | 2/1958 | Sarno | 76/107 |
| 3,036,478 | 5/1962 | Scott et al. | 76/107 |
| 3,461,755 | 8/1969 | Gerew et al. | 83/12 |
| 3,527,123 | 9/1970 | Dovey | 76/107 |
| 3,530,750 | 9/1970 | Daniels | 83/141 |
| 3,826,170 | 7/1974 | Jone et al. | 83/532 X |
| 3,835,746 | 9/1974 | Young, Jr. et al. | 83/698 X |
| 3,863,550 | 2/1975 | Sarka et al. | 93/58.3 |
| 3,941,038 | 3/1976 | Bishop | 83/698 X |
| 4,052,886 | 10/1977 | Buick | 93/58.3 |
| 4,558,620 | 12/1985 | Wallis | 83/698 |
| 4,604,931 | 8/1986 | Bastian et al. | 83/698 X |
| 4,726,270 | 2/1988 | Lucas | 83/13 |
| 4,848,202 | 7/1989 | Crampton | 83/343 |

*Primary Examiner*—Frank T. Yost
*Assistant Examiner*—Kenneth E. Peterson
*Attorney, Agent, or Firm*—Watson, Cole, Grindle & Watson

[57] ABSTRACT

An apparatus is provided for improved retention of steel rule dies inserted into slots of a retaining board. A plurality of chambers are oriented substantially perpendicularly to the direction of insertion and have open faces to permit communication with the slots. A spring is located within each chamber and is connected to a ball shaped member located at the open face. Upon initial insertion of the die, the ball shaped member causes the spring to compress. Once the die is completely inserted, the ball/spring assembly exerts a normal force against the die in the direction of the slot wall opposite the open face. Accordingly, the inserted steel rule dies are securely held within the slots.

10 Claims, 1 Drawing Sheet

STEEL RULE DIE HOLDER

BACKGROUND OF THE INVENTION

1. Technical Field of the Invention

The present invention relates generally to holders and more particularly to holders for steel rule dies of varying widths.

2. Discussion of the Related Art

Steel rule dies are widely used to cut a variety of materials such as cardboard and plastics into a desired shape. Often, the steel rule dies are pressure inserted into slots located in board of wood or other suitable material. During operation of the cutter, these dies often become loosened and ultimately disengaged, thereby necessitating costly and time consuming interruption of the cutting process as repairs are undertaken. In addition, the slots are of varying widths to accommodate dies of varying widths, thus making standardization difficult.

Several attempts have been made to prevent this loosening of the steel rule dies. For example, U.S. Pat. No. 4,052,886 discloses a solid base material having caverns which are filled with semi-rigid filler material to anchor an inserted steel die. However, this method requires time-consuming filling and the ultimate strength of securing is dependant on the filler material selected. U.S. Pat. No. 3,941,038 discloses the use of S-wall shaped resilient members which pin the rule between itself and packing shims. This apparatus necessitates a difficult insertion of the rule between the resilient member and shims. A third proposal is shown in U.S. Pat. No. 3,835,746. A resilient support and spring are deformed upon insertion of the die and thereafter exert an upward force against the die to secure it in a slot. Such a deformation ultimately leads to mechanical failure of the retaining system as the dies are continuously displaced.

Accordingly, it is an object of the present invention to provide an apparatus which securely retains steel rule dies in a retaining board.

It is a further object of the present invention to accomplish the foregoing object without difficult insertion of the steel rule die.

It is yet another object of the present invention to accomplish the preceding objects simply and economically.

It is a still further object of the present invention to achieve the foregoing objects with an apparatus which is durable and long lasting.

It is another object of the present invention to achieve the above objects for steel rule dies of varying widths.

Other objects and advantages will be apparent from the specification and drawings which follow.

SUMMARY OF THE INVENTION

The foregoing and additional objects are obtained by an apparatus according to the present invention for securing steel rule die holders inserted in associated slots located in a retaining board. The apparatus includes a chamber located adjacent to each slot and having an open face opening towards the slot. The chamber is oriented substantially perpendicularly to the direction of insertion of the die. A means for urging the inserted die normally towards a wall of the slot is located opposite the open face of the chamber and is positioned within the chamber. Accordingly, the die is securely held within the slot upon insertion.

DETAILED DESCRIPTION OF THE PREFERRED EMBODIMENTS

Figure 1:
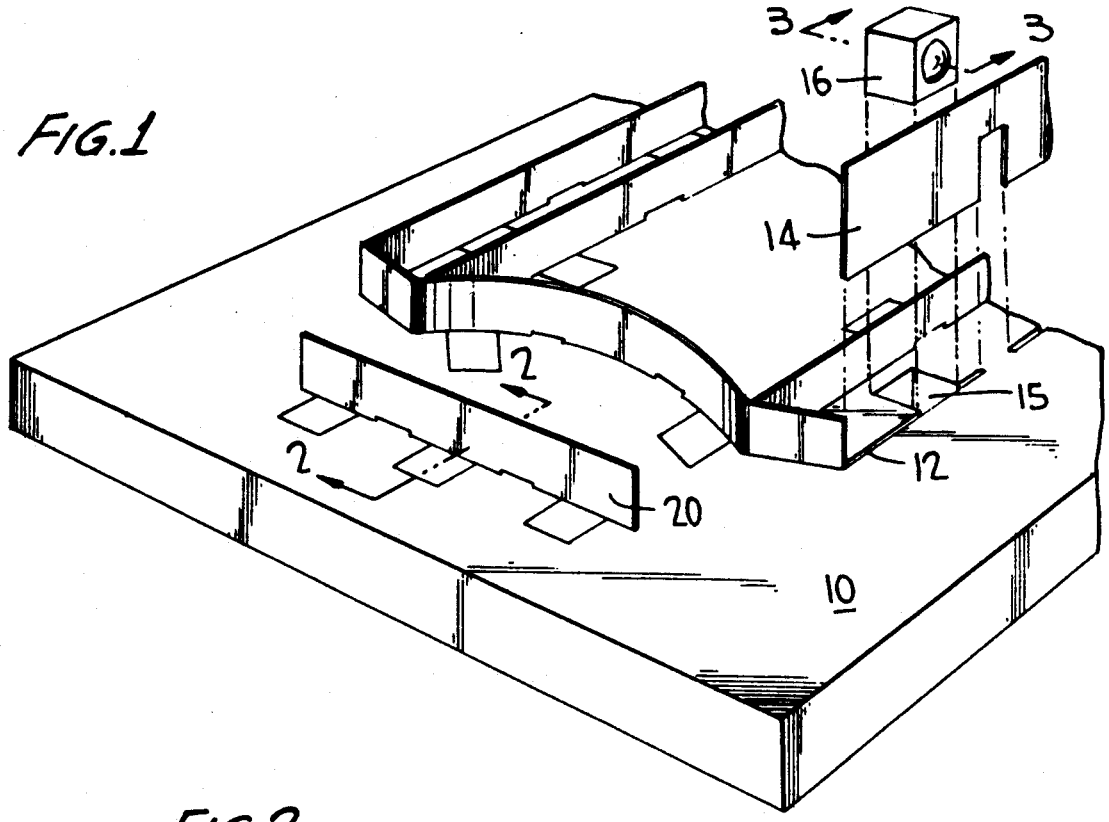
FIG. 1 is a plan view of the steel rule die holder according to the present invention shown in its working environment.

The present invention will now be described in greater detail with reference to the accompanying drawings. Referring to FIG. 1, a retaining board 10 composed of wood, plastic or other suitable material is provided with plurality of slots 12. These slots 12 may be formed by any conventional apparatus such as laser beams or jig saws. Steel rule dies 14 are provided which have a width which is slightly less than the width of an associated slot. Accordingly, steel rule die 14 may be inserted into an associated slot 12.

To prevent the inserted die 14 from loosening within the slot 12, an apparatus according to the present invention is provided. A cube shaped housing 16 is provided within slots 1 adjacent to the slots 12 in a predetermined fashion. Slots 1 are in communication with slots 12 via an open face. As will be apparent to one skilled in the art from the present application, the number and locations of the housings 16 and the associated elements described below is determined by considering such factors as optimum securing of the inserted dies and manufacturing costs.

A channel 18 is provided within each housing 16. Channel 18 is oriented substantially perpendicularly to the direction of the die insertion, i.e., oriented in the widthwise direction of the slot 12. Channel 18 is provided with an open face 20 which opens towards the associated slot 12 to allow communication therewith.

Figure 2:
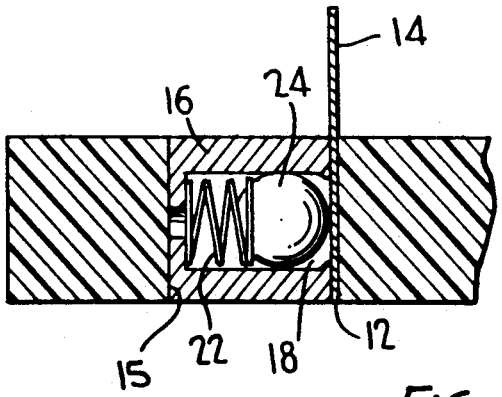
FIG. 2 is an exposed view of the die holder of the present invention taken along line 2—2 of FIG. 1.
Figure 3:
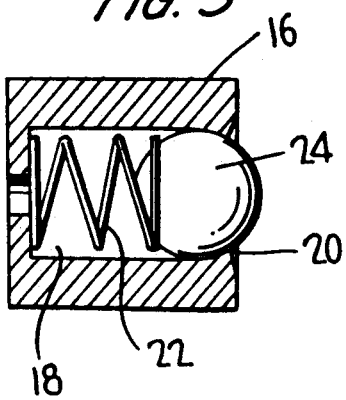
FIG. 3 is an exposed view of the present invention taken along line 3—3 of FIG. 1.

A spring 22 is located within the channel 18 and is connected at one end to the channel wall opposite open face 20. The other end of spring 22 is connected to a ball-shaped member 24. As seen from FIG. 3, spring 22 is selected such that in its natural uncompressed state a portion of ball 24 extends into an unoccupied slot 12. In addition, channel 18 may be configured such that it narrows near open face 20 to define a terminal extension of the spring/ball assembly into an occupied slot, as shown in FIG. 2. Of course, the length and spring constant chosen for spring 22 is merely a matter of design choice for the skilled artisan, taking into account such factors as the space available for channel 18 and the amount of normal force required to adequately secure the inserted die.

When a die 14 is inserted into an associated slot, the resulting downward force of the die is transferred via the ball-shaped member 24 into a force normal to the insertion direction which in turn compresses the spring 22. Once insertion of the die 14 is complete, the ball/-spring assembly exerts a normal force against the inserted steel die 14 to urge it in a direction toward the slot wall located opposite open face 20. Accordingly, loosening and slippage of die 14 inserted into slot 12 is prevented.

The present invention thus prevents down time associated with loose dies. The described apparatus securely holds the dies in a simple, efficient and economic manner. Also, the ball/spring assembly is very durable and can secure dies of varying widths in the slots due to its easy adjustability. Of course, further modifications and improvements will become apparent to one skilled in the art without departing from the spirit and scope of the present invention as defined in the following claims.

I claim:

1. An apparatus for securing a die inserted in a die slot of a retaining board, comprising:

at least one housing slot located adjacent to the die slot, said housing slot having an open face opening towards the die slot and being oriented substantially perpendicular to a direction of insertion of the die; and at least one rectilinearly retractable means for urging the inserted die normally towards a wall of the die slot located opposite the open face of the housing slot, wherein said urging means is positioned within a channel of a housing, said housing having an opening facing said die slot from which a terminal portion of the urging means extends outwardly from the housing into the die slot, said housing being removably frictionally held and insertable into said housing slot, whereby the die is securely held within the die slot upon insertion of said die when said housing is in said housing slot.

2. The apparatus according to claim 1, wherein said urging means comprises a means for transmitting a normal force to the inserted die and a means for resiliently connecting the transmitting means to a wall of said housing slot opposite the opening.

3. The apparatus according to claim 2, wherein the transmitting means is a ball shaped member.

4. The apparatus according to claim 2, wherein the resilient connecting means is a spring having two ends, one end of which is connected to the transmitting means and the end of which is connected to a channel wall opposite the opening.

5. The apparatus according to claim 1, wherein said housing is cube shaped.

6. The apparatus according to claim 1, wherein said channel narrows toward the opening.

7. A method for securing a die within a die slot located in a retaining board, comprising the steps of:

providing a spring actuated rectilinearly retractable urging member in a channel of a housing;

inserting said housing having an opening into a housing slot adjacent to the die slot such that the opening faces the die slot such that a terminal portion of the urging member extends outwardly from the housing into the die slot, said urging member being positioned within said housing, said housing being frictionally held and removably insertable into said housing slot;

inserting the die into the die slot to contact the terminal portion of the urging member;

depressing the spring actuated urging member by continuing to insert the die; and applying a force to the inserted die which is substantially normal to the direction of the insertion via the depressed urging member, whereby the inserted die is secured within the die slot.

8. A method as in claim 7, wherein said housing is cube shaped.

9. A method as in claim 7, wherein said channel narrows toward said opening adjacent the die slot.

10. A method as in claim 7, wherein said urging means comprises a ball and a spring.

* * * * *